US005619106A

United States Patent [19]

Secen

[11] Patent Number: 5,619,106

[45] Date of Patent: Apr. 8, 1997

[54] DIODELESS START CIRCIUT FOR GAS DISCHARGE LAMP HAVING A VOLTAGE DIVIDER CONNECTED ACROSS THE SWITCHING ELEMENT OF THE INVERTER

[75] Inventor: Michael M. Secen, Mentor, Ohio

[73] Assignee: General Electric Company, Schenectady, N.Y.

[21] Appl. No.: 669,679

[22] Filed: Jun. 24, 1996

[51] Int. Cl.[6] ..... H05B 41/14

[52] U.S. Cl. ..... 315/290; 315/DIG. 5

[58] Field of Search ..... 315/289, 290, 315/DIG. 5, DIG. 2, 209 R, 276, 244

[56] References Cited

U.S. PATENT DOCUMENTS

| | | | |
|---|---|---|---|
| 4,184,128 | 1/1980 | Nilssen | 331/113 A |
| 4,353,010 | 10/1982 | Knoll et al. | 315/220 |
| 5,319,286 | 6/1994 | Leyten | 315/290 |
| 5,341,068 | 8/1994 | Nerone | 315/219 |

*Primary Examiner*—Robert Pascal
*Assistant Examiner*—Michael Shingleton
*Attorney, Agent, or Firm*—George E. Hawranko

[57] ABSTRACT

A ballast circuit for a gas discharge lamp comprises a resonant load circuit incorporating a gas discharge lamp and including first and second resonant impedances whose values determine the operating frequency of the resonant load circuit. A d.c.-to-a.c. converter circuit is coupled to the resonant load circuit so as to induce an a.c. current in the resonant load circuit, and comprises first and second switches serially connected in the mentioned order between a bus conductor at a d.c. bus voltage and ground, and having a common switch node through which the a.c. current flows. A bridge capacitor has one end connected to ground. First and second feedback circuits regeneratively control the first and second switches, respectively, in response to a.c. current in the resonant load circuit. A starting circuit initiates operation of the first and second feedback circuits, and incorporates a voltage-divider network comprising first and second serially connected impedances with a common impedance node, and is coupled between the common switch node and ground. Such circuit includes a starting capacitor coupled between the common impedance node and ground, and a voltage-breakover switch coupled between a non-grounded end of the bridge capacitor and the starting capacitor. Also included in the starting circuit is a transformer winding serially coupled to the voltage-breakover switch so as to conduct a pulse of current when the voltage-breakover switch fires, the winding being coupled to the first and second feedback circuits so as to result in a starting pulse of current in the circuits when the voltage-breakover switch fires.

11 Claims, 2 Drawing Sheets

DIODELESS START CIRCIUT FOR GAS DISCHARGE LAMP HAVING A VOLTAGE DIVIDER CONNECTED ACROSS THE SWITCHING ELEMENT OF THE INVERTER

FIELD OF THE INVENTION

The present invention relates to ballast circuits for gas discharge lamps of the type including a d.c. to a.c. converter with a pair of serially connected switches whose operation is controlled by self-resonant feedback circuits. More particularly, the invention relates to a circuit for starting self-resonant operation of a ballast circuit that does not require a p-n diode for preventing during steady state ballast operation the firing of a voltage-breakover switch used to create a starting pulse.

BACKGROUND OF THE INVENTION

The prior art provides ballast circuits for gas discharge lamps of the type including a d.c. to a.c. converter with a pair of serially connected switches whose operation is controlled by self-resonant feedback circuits. A starting circuit is included to initiate self-resonant oscillation of the ballast circuits. This is accomplished by creating a pulse of current through a voltage-breakover (VB) switch, such as a diac, which is accomplished by biasing the VB switch to its threshold voltage for firing (i.e., becoming conductive). During steady state operation of the starting circuit, it is necessary to keep the voltage across the VB switch below its threshold for firing, and one typical circuit to accomplish this includes a p-n diode with its cathode connected to the common node between the mentioned pair of switches. For instance, such a p-n diode is included in the starting circuit disclosed in U.S. Pat. No. 4,353,010.

The cost of the p-n diode used in prior art starting circuits is high relative to the cost of other circuit components, such as resistors. It would, therefore, be desirable to provide a ballast circuit including a starting circuit that did not require a p-n diode for preventing firing of a VB switch during steady state ballast operation.

OBJECTS AND SUMMARY OF THE INVENTION

Accordingly, it is an object of the invention to provide ballast circuits for gas discharge lamps of the type including a d.c. to a.c. converter with a pair of serially connected switches whose operation is controlled by self-resonant feedback circuits, including a starting circuit not requiring a p-n diode to prevent firing of a voltage-breakover switch during steady state ballast operation.

A further object of the invention is to provide ballast circuits of the foregoing type using readily available circuit components.

The foregoing objects are achieved in a ballast circuit for a gas discharge lamp, comprising a resonant load circuit incorporating a gas discharge lamp and including first and second resonant impedances whose values determine the operating frequency of the resonant load circuit. A d.c.-to-a.c. converter circuit is coupled to the resonant load circuit so as to induce an a.c. current in the resonant load circuit, and comprises first and second switches serially connected in the mentioned order between a bus conductor at a d.c. bus voltage and ground, and having a common switch node through which the a.c. current flows. A bridge capacitor has one end connected to ground. First and second feedback circuits regeneratively control the first and second switches, respectively, in response to a.c. current in the resonant load circuit. A starting circuit initiates operation of the first and second feedback circuits, and incorporates a voltage-divider network comprising first and second serially connected impedances with a common impedance node, and is coupled between the common switch node and ground. Such circuit includes a starting capacitor coupled between the common impedance node and ground, and a voltage-breakover switch coupled between a non-grounded end of the bridge capacitor and the starting capacitor. Also included in the starting circuit is a transformer winding serially coupled to the voltage-breakover switch so as to conduct a pulse of current when the voltage-breakover switch fires, the winding being coupled to the first and second feedback circuits so as to result in a starting pulse of current in the circuits when the voltage-breakover switch fires.

BRIEF DESCRIPTION OF THE DRAWING FIGURES

The foregoing, and further, objects and advantages of the invention will become apparent from the following description taken in conjunction with the drawing, in which.

DETAILED DESCRIPTION OF THE PREFERRED EMBODIMENTS

Figure 1:
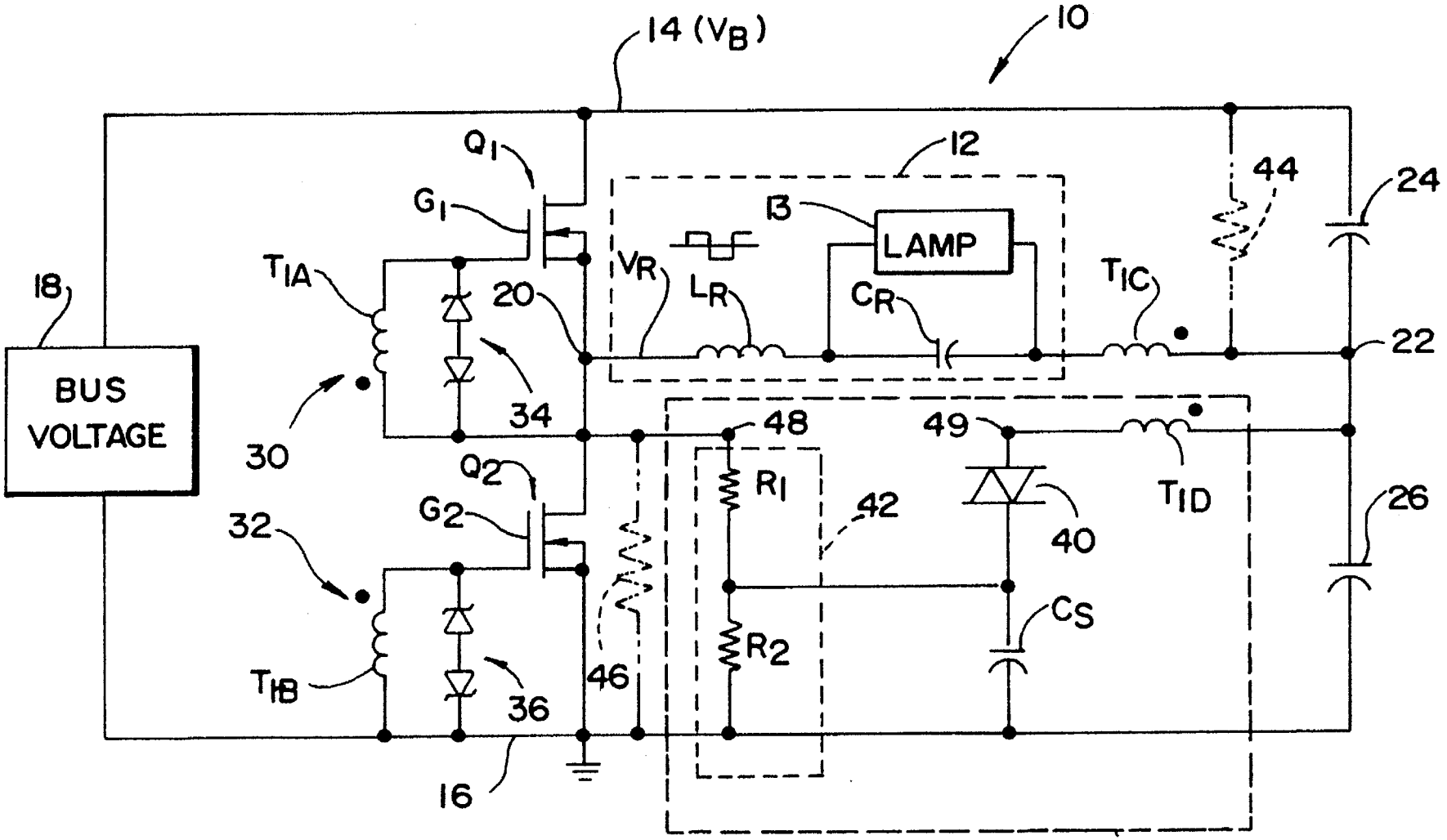
FIG. 1 is a schematic diagram, partially in block form, of a power supply circuit including feedback circuitry for controlling the conduction states of a pair of switches of a half-bridge converter.

In the drawing figures, in which like reference numerals or characters refer to like parts, FIG. 1 shows a power supply circuit 10 for a resonant load circuit 12. Resonant load circuit 12 may include a gas discharge lamp 13, such as a fluorescent lamp. Electrical power for resonant load circuit 12 is provided by a bus voltage $V_B$ impressed between a d.c. bus conductor 14 and a reference, or ground, conductor 16, which is not necessarily at earth ground. Bus voltage $V_B$ is provided by a bus voltage generator 18, typically comprising a conventional full-wave rectifier, for rectifying a.c. voltage from an a.c. source, or line, voltage (not shown). Bus voltage generator 18, optionally, may include a power factor correction circuit, as is conventional.

Power supply circuit 10 impresses a bidirectional, resonant load voltage $V_R$ across resonant load circuit 12, from left-shown node 20 to right-shown node 22., which, in turn, induces bidirectional current through resonant load circuit 12.

To generate resonant load voltage $V_R$ from d.c. bus voltage $V_B$ on d.c. bus 14, power supply circuit 10 conventionally includes a series half-bridge converter, including series-connected MOSFETs (Metal-Oxide-Semiconductor Field-Effect Transistors), or other switches, $Q_1$ and $Q_2$. The drain of MOSFET $Q_1$ is directly connected to d.c. bus 14, and its source is connected to the drain of MOSFET $Q_2$ at node 20, which is common to switches $Q_1$ and $Q_2$. The drain of MOSFET $Q_2$ is connected to ground 16. The conduction states of MOSFETs $Q_1$ and $Q_2$ are determined by respective control voltages on the respective gates $G_1$ and $G_2$ of the MOSFETs. In brief overview, bidirectional, resonant load voltage $V_R$ is generated by alternately connecting common node 20 to d.c. bus 14, which is at bus voltage $V_B$, via MOSFET $Q_1$, and then to ground 16, via MOSFET $Q_2$. Serially connected "bridge" capacitors 24 and 26, connected between d.c. bus 14 and ground 16, maintain right-shown node 22 of resonant load circuit 12 at approximately ½ of d.c. bus voltage $V_B$.

In an alternative circuit in accordance with conventional practice, bridge capacitor 24 may be omitted and replaced with a capacitor (not shown) connected between bus 14 and ground 16, and with bridge capacitor remaining in the position illustrated.

Control signals are provided on gates $G_1$ and $G_2$ of MOSFETs $Q_1$ and $Q_2$ by respective feedback circuits 30 and 32. Feedback circuits 30 and 32 are responsive to a current from part of resonant load circuit 12 that is sensed by transformer winding $T_{1C}$, which is coupled to windings $T_{1A}$ and $T_{1B}$ of the feedback circuits. Included in feedback circuits 30 and 32 are respective pairs of back-to-back (i.e. cathode-to-cathode) connected Zener diodes 34 and 36. These Zener diode pairs clamp the voltage on their respective gates $G_1$ and $G_2$, with respect to the voltage on the lower-shown nodes of their associated switches $Q_1$ and $Q_2$, at a positive or a negative level with a timing determined by the polarity and amplitude of feedback current (not shown) in the respective windings $T_{1A}$ and $T_{1B}$. Respective, inherent capacitances (not shown) of the gates $G_1$ and $G_2$ also influence the behavior of feedback circuits 30 and 32.

A starting circuit 38 is provided for initiating oscillation of resonant voltage $V_R$. This is accomplished by providing a pulse of current through a winding $T_{1D}$, which is coupled to windings $T_{1A}$ and $T_{1B}$ of feedback circuits 30 and 32. The pulse of current through winding $T_{1D}$ occurs when a switch 40 comprising a voltage-breakover (VB) switch, such as a diac, fires (i.e. begins conducting). The voltage across switch 40 is determined by the difference of the voltages between bridge capacitor 26 and a starting capacitor $C_S$. The voltage on starting capacitor $C_S$ is determined by a voltage-divider network 42, which includes two serially connected impedances, for instance, resistors $R_1$ and $R_2$, connected between node 20 and ground 16, and whose common node is connected to the non-grounded end of starting capacitor $C_S$.

Two criteria may be used in selecting the value of resistor $R_1$. The first criterion can be expressed by the equation: $(R_1*R_2/(R_1+R_2))*C_S \approx 100$ times steady state switching frequency, where "*" indicates multiplication, and "≈" means approximately. The second criterion is to minimize the power dissipation in resistor $R_1$. With resistor $R_1$ so sized, the value for resistor $R_2$ may be chosen to assure that sufficient voltage exists on capacitor $C_S$ to prevent VB switch 40 from firing when bus voltage $V_B$ is at a maximum value, and the voltage across VB switch 40 is at a minimum value.

Details of operation of starting circuit 38 are now considered during an initial bus energization phase, a start phase, a steady state phase, and an oscillation-interrupted phase.

INITIAL BUS ENERGIZATION PHASE

When bus voltage generator 18 is first energized, the self-regenerative switching of switches $Q_1$ and $Q_2$ has not yet started. Bridge capacitor 26 charges to about ½ of bus voltage $V_B$. At typical lamp operating frequencies (e.g., from several kilohertz to 150 kilohertz), with resistors $R_1$ and $R_2$ chosen as described above, the voltage on bridge capacitor 26 rises faster than the voltage on starting capacitor $C_S$. To allow switch 40 to refire, starting capacitor $C_S$ should quickly discharge through resistor $R_2$, or where resistor 46 is present (as described below), through the parallel combination of resistor $R_2$ and serially connected resistor $R_1$ and resistor 46. For this purpose, the resistor-capacitor time constant for capacitor $C_S$ and the applicable one of the foregoing resistances should be relatively short, such as 10 milliseconds.

With the values of $R_1$, $R_2$ and $C_S$ chosen according to the above criteria, switch 40 can re-fire several (e.g., 5 to 10) times after the ballast circuit has begun oscillation. This provides additional starting pulses should circuit oscillation not be reached with an earlier pulse or pulses due to circuit instability, for instance, or if a user, while trying to turn on a lamp, accidentally turns off the power momentarily.

START PHASE

During the start phase, the voltage on bridge capacitor 26 quickly reaches about ½ bus voltage $V_B$ while the voltage on starting capacitor $C_S$ remains sufficiently low to result in the voltage across switch 40 exceeding its voltage-breakover threshold. This causes bridge capacitor 26, which is at a higher voltage than starting capacitor $C_S$, to rapidly supply charge to starting capacitor $C_S$ through winding $T_{1D}$. By thus raising the voltage on starting capacitor $C_S$, the voltage across switch 40 is reduced sufficiently to allow switch 40 to turn off.

STEADY STATE PHASE

During a steady state phase of operation, node 20 appears to starting capacitor $C_S$ as about ½ bus voltage $V_B$, since such capacitor and resistor $R_1$ form a low pass filter. During this phase, starting capacitor $C_S$ becomes charged via resistor $R_1$, to prevent refiring of switch 40.

OSCILLATION-INTERRUPTED PHASE

When oscillation of the ballast circuit has been interrupted, due to circuit instability or momentary depowering, for instance, a rapid restart of the lamp can be achieved by quickly discharging starting capacitor $C_S$. This allows the voltage across switch 40, which increases as the voltage on starting capacitor $C_S$ falls, to rise to the voltage-breakover threshold of the switch, causing it to rerire.

If switch 40 has considerable leakage current, there could be a tendency for bridge capacitor 26 to discharge through the d.c. path to ground comprising winding $T_{1D}$, switch 40, and resistor $R_2$. Therefore, resistor 44 (shown in phantom) coupled between bus 14 and bridge capacitor 44 may be used to provide a current path for supplying switch 40 with leakage current, to thereby maintain approximately constant the charge on bridge capacitor 26. Typically, resistor 44 is sized to provide sufficient current to $V_B$ switch 40 to prevent undesirable discharging of bridge capacitor 26 where bus voltage $V_B$ is assumed to be at its minimum value of operation.

If leakage current of switch $Q_1$ that flows through voltage-divider network 42 would cause undesirably high voltage on node 20 such that starting capacitor $C_S$ could not discharge to a point at which VB switch 40 could fire, then a resistor 46 (shown in phantom) could be shunted across switch $Q_2$ for sinking a portion of such leakage current. This alleviates a constraint in selecting values of resistors $R_1$ and $R_2$.

Figure 2:
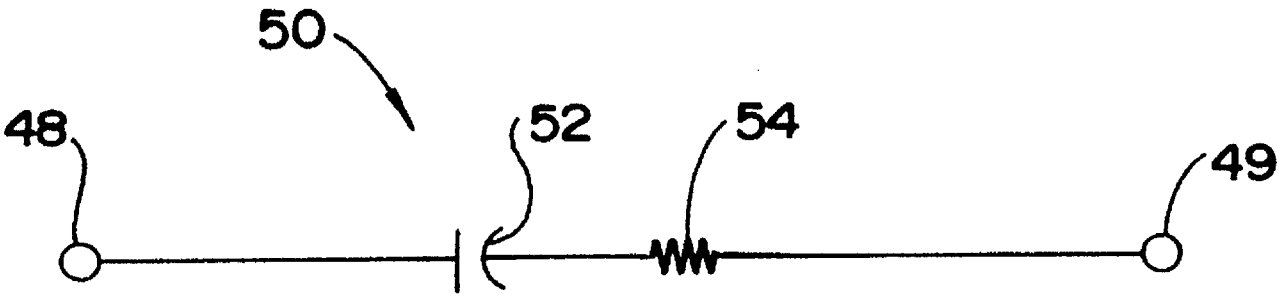
FIG. 2 is a circuit diagram of a snubber & gate speed-up circuit that may be used in the power supply circuit of FIG. 1.

Starting circuit 38 may beneficially be combined with a snubber & gate speed-up circuit 50 as shown in FIG. 2, which is connected between nodes 48 and 49 in FIG. 1. Circuit 50 comprises, in serial connection, a capacitor 52 and a resistor 54, which are serially coupled to transformer winding $T_{1D}$ shown in FIG. 1. Resistor 54 serves to reduce parasitic interaction between capacitor 52 and any other reactances coupled to it.

Capacitor 52 operates, first, in a so-called snubbing mode, wherein it stores energy from resonant load circuit 12 during an interval in which one of MOSFETs $Q_1$ and $Q_2$ has turned off, but the other has not yet turned on. The energy stored in capacitor 52 is thereby diverted from MOSFETs $Q_1$ and $Q_2$, which, in the absence of snubbing capacitor 52, would dissipate such energy in the form of heat while switching between conductive and non-conductive states. Further details of the snubbing role of capacitor 52 are described in U.S. Pat. No. 5,341,068 issued on Aug. 23, 1994, entitled "Electronic Ballast Arrangement for a Compact Fluorescent Lamp", by Louis R. Nerone, and assigned to the present assignee.

Capacitor 52, secondly, operates to increase the speed of switching of MOSFETs $Q_1$ and $Q_2$. In this role, capacitor 52 creates a speed-up pulse when a rising current in the capacitor, induced in winding $T_{1D}$, occurs. The rising current is induced in winding $T_{1D}$ from rising current in current-sensing winding $T_{1C}$ of FIG. 1. Further details of this gate speed-up role of capacitor are described in the foregoing patent of Louis R. Nerone.

Referring to FIG. 1 unless otherwise noted, exemplary component values are: a fluorescent lamp 13 rated at 20 watts, at a nominal line voltage of 120 volts a.c., IRFR214-model MOSFETs $Q_1$ and $Q_2$ from the International Rectifier Corporation of El Segundo, Calif. under their trademark HEXFET; upper and lower diodes of the Zener diode pair 34 and 36, rated at 7.5 and 10 volts, respectively; the respective numbers of turns for coupled transformer windings $T_{1A}$, $T_{1B}$, $T_{1C}$ and $T_{1D}$, 40, 40, 4 and 4; resonant inductor $L_R$, 630 micro henries; resonant capacitor $C_R$, 2.7 nanofarads; bridge capacitors 24 and 26, each 0.22 micro farads; respective values for resistors $R_1$, $R_2$, 44 and 46, 100 k, 560 k, 560 k, and 560 k ohms; capacitance of starting capacitor $C_S$, 0.01 micro farads; voltage-breakover switch 40, a diac sold under trade designation HT-32 by Teccor Electronics, Inc., of Irving, Tex.; capacitor 52 (FIG. 2), 220 pico farads; and resistor 54 (FIG. 2), 100 ohms.

From the foregoing, it will be appreciated that the invention provides ballast circuits for gas discharge lamps of the type including a d.c. to a.c. converter with a pair of serially connected switches whose operation is controlled by self-resonant feedback circuits, including a starting circuit not requiring a p-n diode to prevent firing of a voltage-breakover switch during steady state ballast operation. Such ballast circuits of the foregoing type can be made using readily available circuit components.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit for a gas discharge lamp, comprising:

(a) a resonant load circuit incorporating a gas discharge lamp and including first and second resonant impedances whose values determine the operating frequency of said resonant load circuit;

(b) a d.c.-to-a.c. converter circuit coupled to said resonant load circuit so as to induce an a.c. current in said resonant load circuit, and comprising first and second switches serially connected in the mentioned order between a bus conductor at a d.c. bus voltage and ground, and having a common switch node through which said a.c. current flows;

(c) a bridge capacitor having one end connected to said ground;

(d) first and second feedback circuits for regeneratively controlling said first and second switches, respectively, in response to a.c. current in said resonant load circuit; and (e) a starting circuit for initiating operation of said first and second feedback circuits, comprising:

(I) a voltage-divider network comprising first and second serially connected impedances with a common impedance node, and being coupled between said common switch node and said ground;

(ii) a starting capacitor coupled between said common impedance node and said ground;

(iii) a voltage-breakover switch coupled between a non-grounded end of said bridge capacitor and said starting capacitor; and (iv) a transformer winding serially coupled to said voltage-breakover switch so as to conduct a pulse of current when said voltage-breakover switch fires; said winding being coupled to said first and second feedback circuits so as to result in a starting pulse of current in said circuits when said voltage-breakover switch fires.

2. The ballast circuit of claim 1, wherein said first and second serially connected impedances of said voltage-divider network comprise resistors.

3. The ballast circuit of claim 1, further comprising an impedance connected between said bus conductor and said bridge capacitor so as to maintain a desired voltage on said bridge capacitor which would otherwise tend to fall due to leakage current through said voltage-breakover switch.

4. The ballast circuit of claim 1, further comprising an impedance shunting said second switch so as to conduct a portion of leakage current from said first switch to said ground.

5. The ballast circuit of claim 1, wherein said gas discharge lamp comprises a fluorescent lamp.

6. A ballast circuit for a gas discharge lamp, comprising:

(a) a resonant load circuit incorporating a gas discharge lamp and including first and second resonant impedances whose values determine the operating frequency of said resonant load circuit;

(b) a d.c.-to-a.c. converter circuit coupled to said resonant load circuit so as to induce an a.c. current in said resonant load circuit, and comprising first and second switches serially connected in the mentioned order between a bus conductor at a d.c. bus voltage and ground, and having a common switch node through which said a.c. current flows;

(c) a bridge capacitor having one end connected to said ground;

(d) first and second feedback circuits for regeneratively controlling said first and second switches, respectively, in response to a.c. current in said resonant load circuit;

(e) a starting circuit for initiating operation of said first and second feedback circuits, comprising:

(I) a voltage-divider network comprising first and second serially connected impedances with a common impedance node, and being coupled between said common switch node and said ground;

(ii) a starting capacitor coupled between said common impedance node and said ground;

(iii) a voltage-breakover switch coupled between a non-grounded end of said bridge capacitor and said starting capacitor; and (iv) a transformer winding serially coupled to said voltage-breakover switch so as to conduct a pulse of current when said voltage-breakover switch fires; said winding being coupled to said first and second feedback circuits so as to result in a starting pulse of current in said circuits when said voltage-breakover switch fires; and (f) a serially connected capacitor and resistor coupled between said common switch node and said transformer winding in such a manner that said transformer winding is used both to increase the speed of switching of said first and second switches and to result in a starting pulse of current in said first and second feedback circuits.

7. The ballast circuit of claim 6, wherein said first and second serially connected impedances of said voltage-divider network comprise resistors.

8. The ballast circuit of claim 6, further comprising an impedance connected between said bus conductor and said bridge capacitor so as to maintain a desired voltage on said bridge capacitor which would otherwise tend to fall due to leakage current through said voltage-breakover switch.

9. The ballast circuit of claim 6, further comprising an impedance connected between said bus conductor and said bridge capacitor so as to maintain a desired voltage on said bridge capacitor which would otherwise tend to fall due to leakage current through said voltage-breakover switch.

10. The ballast circuit of claim 6, further comprising an impedance shunting said second switch so as to conduct a portion of leakage current from said first switch to said ground.

11. The ballast circuit of claim 9, wherein said gas discharge lamp comprises a fluorescent lamp.

* * * * *